US007600339B2

(12) United States Patent
Schumacher et al.

(10) Patent No.: US 7,600,339 B2
(45) Date of Patent: Oct. 13, 2009

(54) WEAPONS FIRING SAFETIES AND METHODS OF OPERATING THE SAME

(75) Inventors: Michael Schumacher, Fluorn-Winzeln (DE); Rudi Beckmann, Aichhalden-Rotenberg (DE); Marc Roth, Oberndorf (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 23 days.

(21) Appl. No.: 11/603,783

(22) Filed: Nov. 22, 2006

(65) Prior Publication Data

US 2007/0180749 A1 Aug. 9, 2007

Related U.S. Application Data

(63) Continuation of application No. PCT/EP2005/005674, filed on May 25, 2005.

(30) Foreign Application Priority Data

May 26, 2004 (DE) ..... 10 2004 025 718

(51) Int. Cl.
*F41A 17/06* (2006.01)

(52) U.S. Cl. ..... 42/70.01; 42/70.06; 42/70.08

(58) Field of Classification Search ..... 42/70.01, 42/70.06, 70.08, 70.11
See application file for complete search history.

(56) References Cited

U.S. PATENT DOCUMENTS 3,703,845 A 11/1972 Griew
5,068,989 A 12/1991 Martin
5,192,818 A 3/1993 Martin (Continued)

FOREIGN PATENT DOCUMENTS

DE 25 05 604 8/1976

(Continued)

OTHER PUBLICATIONS

English translation of the Written Opinion of the International Preliminary Examination Report for international patent application serial No. PCT/EP2005/005674.

(Continued)

*Primary Examiner*—Stephen M Johnson
(74) *Attorney, Agent, or Firm*—Hanley, Flight & Zimmerman, LLC

(57) ABSTRACT

Weapons safety systems and methods of operating the system are described. An example weapons safety system in which the enabling of a weapon to shoot is controlled by means of an exchange of identification between the weapon and an enabling apparatus. An example weapon includes a weapon identification code and a safety device. An example enabling apparatus that is designed to capture the weapon identification code and to transmit an enabling signal to the safety device in the weapon includes a control unit. The control unit controls the enabling device and includes an identification memory that includes at least one registered weapon identification. Upon receiving a control signal from the enabling apparatus, the weapon transmits an identification signal that contains the weapon identification code. In addition, the enabling apparatus sends a weapon-enabling signal if the weapon identification code matches at least one of the registered weapon identification. Furthermore, the enabling apparatus may change the identification code.

22 Claims, 3 Drawing Sheets

U.S. PATENT DOCUMENTS

| | | | | |
|---|---|---|---|---|
| 5,423,143 | A | 6/1995 | Martin | |
| 5,537,771 | A | 7/1996 | Martin | |
| 5,675,925 | A | 10/1997 | Wuger | |
| 5,704,153 | A | 1/1998 | Kaminski et al. | |
| 5,867,930 | A | 2/1999 | Kaminski et al. | |
| 5,896,691 | A | 4/1999 | Kaminski et al. | |
| 5,953,844 | A | 9/1999 | Harling et al. | |
| 6,223,461 | B1 * | 5/2001 | Mardirossian | 42/70.11 |
| 6,237,271 | B1 | 5/2001 | Kaminski | |
| 6,412,207 | B1 * | 7/2002 | Crye et al. | 42/70.06 |
| 6,415,542 | B1 | 7/2002 | Bated et al. | |
| 6,510,642 | B2 | 1/2003 | Riener | |
| 6,678,984 | B1 | 1/2004 | Rapp et al. | |
| 6,735,897 | B1 * | 5/2004 | Schmitter et al. | 42/70.01 |
| 6,995,652 | B2 | 2/2006 | Carrender et al. | |
| 2001/0032405 | A1 | 10/2001 | Kaminski | |
| 2002/0032976 | A1 | 3/2002 | Riener | |
| 2002/0149468 | A1 * | 10/2002 | Carrender et al. | 340/5.61 |
| 2003/0097776 | A1 * | 5/2003 | Brosow | 42/70.01 |

FOREIGN PATENT DOCUMENTS

| | | |
|---|---|---|
| DE | 29 40 513 | 4/1981 |
| DE | 44 46 020 | 6/1996 |
| DE | 19822206 | 11/1999 |
| DE | 10037227 | 2/2002 |
| DE | 102 22 332 | 12/2003 |
| DE | 102 25 861 | 12/2003 |
| DE | 10227093 | 2/2004 |
| EP | 1130351 | 9/2001 |
| WO | 9804880 | 2/1998 |
| WO | 02084584 | 10/2002 |

OTHER PUBLICATIONS

International Search Report for international patent application serial No. PCT/EP2005/005674.

German Patent and Trademark Office, German Office action issued on Oct. 8, 2007, in connection with German Application No. 102004025718.3. 2 Pages.

* cited by examiner

WEAPONS FIRING SAFETIES AND METHODS OF OPERATING THE SAME

RELATED APPLICATIONS

This patent is a continuation of International Patent Application Serial No. PCT/EP2005/005674, filed May 25, 2005, which claims priority to German Patent Application 10 2004 025 718.3, filed on May 26, 2004, both of which are hereby incorporated herein by reference in their entireties.

FIELD OF DISCLOSURE

This disclosure relates generally to firearms, and, more particularly, to a weapons firing safeties that include a weapons identification exchange with an enabling device.

BACKGROUND

Communications systems have been used to control firearm safeties for some time. For example, some communications controlled firearm safeties have been described in German Patents DE 25 05 604; DE 29 40 513; and DE 102 22 332 and in U.S. Pat. No. 3,703,845. According to German Patent DE 25 05 604, a transmitter sends signals (for example, light signals) to a weapon to enable certain operations of the weapon. The signals are directed toward a receiver mounted on the weapon. According to German Patent DE 29 40 513, such signals—e.g., infrared light signals—are encoded, and the weapon safety device includes a decoding device, which only releases certain functions of the weapon depending on which encoded signal is received by the weapon safety device. For example, one signal may be sent for unlocking the weapon to allow loading and unloading, and another signal may be sent for unlocking the weapon to allow shooting.

U.S. Pat. No. 3,703,845 describes an electromagnetic unlocking and locking device. In addition, German Patent DE 102 22 332 describes a pattern transmitter (code transmitter) that transmits signals in the form of radio waves, acoustic signals, optical signals or electrical signals to a weapon, and the weapon itself comprises an electronic comparator circuit, which checks the received signal patterns for their validity and only unlocks (releases the safety of) the weapon if a valid signal is received.

All these systems are basically suitable to be used in a shooting facility or in a shooting range in order restrict the use of weapons to a certain spatial range. That is, the weapon may only be shot, for example, in a certain direction or only in a certain zone, in which it can receive the corresponding release signals. Also, as described above with German Patent DE 102 22 332, a weapon may be arranged to acknowledge different release signals, i.e., different signals intended to enable different operations. As described in German Patent DE 102 22 332, this may be done using changing signal patterns created by means of corresponding dialog functions. Thus, the weapon may receive a variety of signals from the enabling apparatus. However, the information exchange between the weapon and the enabling apparatus is limited to the weapon sending an inquiry signal to the pattern transmitter, which then transmits a corresponding release signal to the weapon. The pattern transmitter releases every weapon, which has sent an inquiry signal, and that is located within the transmission range of the enabling apparatus. Thus, this system does not provide an individually controllable release of weapons. It means that the flexibility of these systems with relation to the controllable weapons is limited. So, for example, the only way to ensure that a lost or stolen weapon can no longer be activated by the enabling device (i.e., the pattern transmitter) is to change the signal pattern for the release signal and/or for the inquiry signal. To achieve this, the signal receivers and the inquiry signal transmitters on the weapons that are to continue to be released (i.e., authorized weapons) must be changed accordingly.

U.S. Pat. No. 6,237,271 also discloses weapon safety that is controlled via communications. In U.S. Pat. No. 6,237,271, a weapon-based transmitter sends an inquiry signal, which is received by a weapon-independent enabling apparatus, which then transmits an identification signal to a receiver in the weapon. The receiver, upon receiving this identification signal, then triggers a weapon-based safety device to enable the weapon. In the system of the '271 patent, the actual identification and enabling process are performed from the weapon itself. This means that the exchange of identification requires an active transmitter on the weapon. This arrangement does not allow an exchange of identification controlled exclusively by a weapon-independent enabling apparatus.

DETAILED DESCRIPTION

The present description relates to weapons firing safety systems that enable the firing of a weapon (i.e., bring the weapon into a functional condition) by means of an identification exchange between the weapon and an enabling apparatus. In this system, the example weapon includes an individual weapon identification and a safety device. The enabling apparatus captures the weapon identification and, if appropriate, sends a release signal to the safety device arranged in the weapon. The example enabling apparatus includes a control unit and an identification memory. Further, the enabling apparatus is controlled in that the release signal is only sent if the captured weapon identification matches a weapon identification registered in the identification memory.

Figure 1:
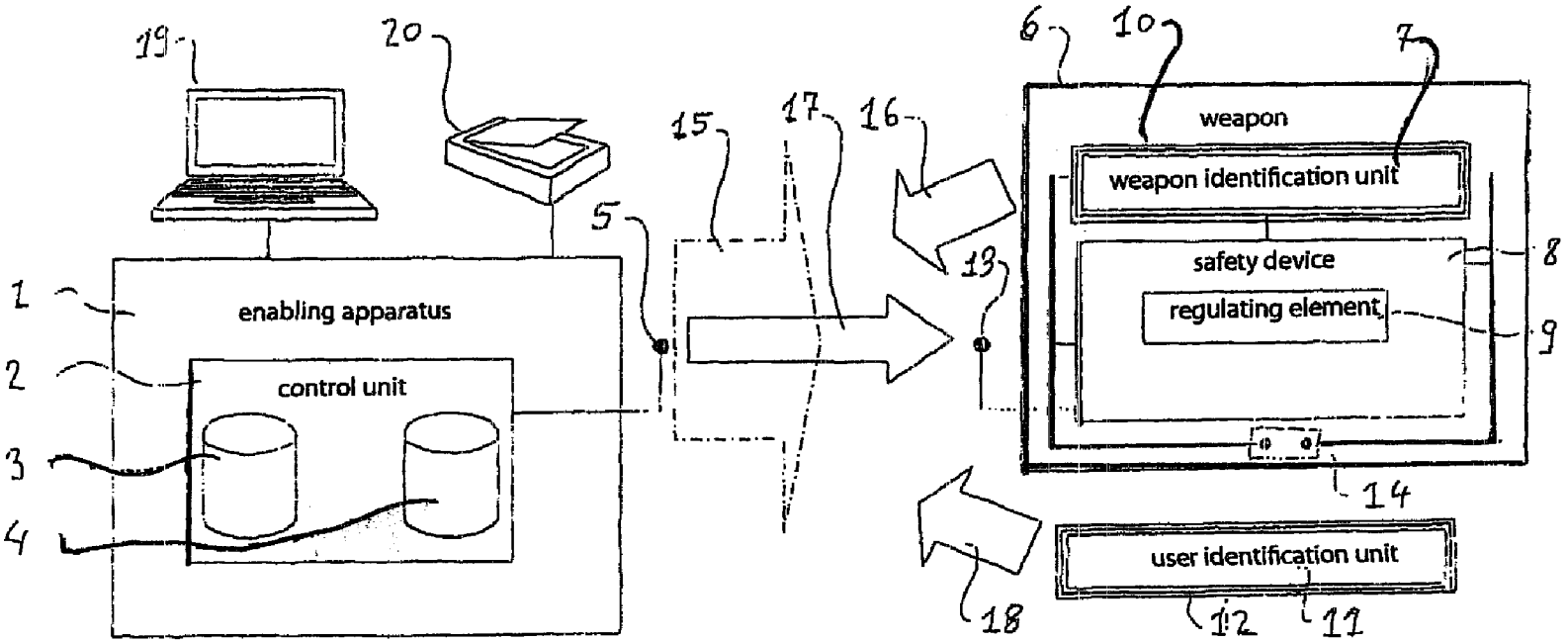
FIG. 1 shows a schematic illustration of an example weapons safety system.

FIG. 1 shows an example design of a weapons safety system. The schematic illustration shows an example enabling apparatus 1 with a control unit 2, and the control unit includes a plurality of identification memories 3 and 4, whose function is explained in greater detail below. In addition, the control unit 2 may be implemented using a computer, for example, a personal computer (PC). Furthermore, the control unit 2 is equipped with a first antenna 5, through which signals are transmitted and received that are generated or processed by the control unit 2. An example weapon 6 includes a weapon identification 7 and is equipped with a safety device 8, which is operatively coupled to the weapon through a regulating element 9. The weapon identification 7 may be located on an identification carrier 10, which is shown in FIG. 1 by a triple bordered frame surrounding the weapon identification 7. The safety device 8 also may be connected to a second antenna 13 to transmit or receive signals. However, the second antenna 13 is optional, thus, the second antenna 13 is shown in FIG. 1 to be coupled to the safety device 8 via a dotted connection line. Alternatively, the exchange of signal also may occur through an antenna associated with the identification carrier 10, which is designed as a transponder. The weapon identification carrier 10 and the safety device are supplied with energy by means of an energy supply 14. The identification carrier 10 is also optional and, thus, dotted connection lines are shown in FIG. 1 to couple the identification carrier 10 to the power supply 14. In addition, energy reception through the signal antenna, i.e., the second antenna 13 is possible, too.

The example system also may include a user identification 11, which is located on another identification carrier 12, which also may be designed as a transponder with its own transmission and reception antennas.

Example transponders that are suitable for the illustrated system include, for example, radio frequency identification (RFID) data carriers that have memory function. The transponder may be designed in a whole range of variants starting with a simple read-only transponder up to a sophisticated transponder equipped with encoding functions. In their basic design, transponders with a memory function contain a memory (for example, a RAM, ROM, EEPROM or FeRAM) and a high frequency (HF) interface for power supply and communication with the read/write device. The HF interface thereby forms the interface between a transfer channel from the read/write device to the transponder and the digital circuit elements of the transponder itself. In general, the HF interface corresponds with a classic modem (modulator/demodulator), as the HF interface is also used for analog data transfer via telephone lines. The HF interface of the transponder has a load or backscatter modulator (or another procedure, such as, for example, a frequency divider or a count-down oscillator), which is activated by the digital transmission data in order to send data back to the read device. Passive transponders, i.e., transponders without their own power supply, are supplied with power via the HF field of the read/write device. The HF interface receives current from the transponder antenna and provides it, in the form of a direct current, to the chip as a regulated voltage supply. The transponders may be provided with their own microprocessors, which execute data transfer from and to the transponder and process control of commands, file management and cryptographical or encoding algorithms.

It is also possible to equip transponders with sensor functions, so that temperature, humidity, shock, acceleration or other physical variables, for example, can be recorded in the transponder and can be output by a read/write device. Thus, for example, critical operating variables can be captured for weapons. Other example data include the maximum attained temperature of a weapon barrel or the number of shots fired. The recording of such parameters allows the weapon to be controlled (e.g., enabled) based on the actual characteristics of the operation of the weapon. For example, the weapon may be locked after a certain number of shots or upon reaching a limit temperature.

In addition, glass transponders may be used in some examples. Glass transponders, the inductors of which are coiled around a highly permeable ferrite rod (ferrite antenna), are suitable for the installation of transponders in a metallic environment, such as the environment of a firearm. In the case of an installation in an oblong depression or recess of a metal surface, the transponder may be easily read. Even covering such an arrangement with a metal cover is possible if the cover is fastened between the two metal surfaces with a narrow slot or gap of dielectric material (e.g., paint, plastic). Thus, the field lines running parallel to the metallic surface may enter the hollow area via the dielectric gap so that the transponder can be read. In addition, so-called disk tags (disk-shaped transponders) may be embedded between metal plates. The top and bottom sides of the tags are covered with metallic foil made of a highly permeable amorphous metal, each of which cover only one half of the tag so that a magnetic flow through the inductor of the transponder is created at the slot or gap between the two foil parts so that the transponder can be read.

For installation in non-metallic bodies, there are a number of flat, rod-shaped or other transponder designs that can be glued on/in, cast in, poured in, screwed in or otherwise fastened to the non-metallic body. For instance the transponders may be so flat that the transponders may even be applied along the surfaces of a weapon.

As shown in FIG. 1, an example process of enabling the weapon 6 within the weapon safety system proceeds as follows: Through the first antenna 5, the control unit 2 transmits a global control signal 15, which is received either by the second antenna 13 of the weapon-side safety device 8 or directly by the transponder 10 (i.e., the transponder of the identification carrier) that carries the weapon identification 7. In response to the global signal 15, the transponder 10 transmits a weapon identification signal 16 that contains the weapon identification 7 back to the enabling apparatus 1, which receives this weapon identification signal 16 through the first antenna 5 and transmits the weapon identification signal 16 to the control unit 2. The control unit 2 then carries out a comparison operation to verify whether the transmitted weapon identification 7 matches any identification recorded in the weapon identification memory 3. If the weapon identification 7 matches an already-recorded weapon identification in the weapon identification memory 3, the control unit 2 transmits, again, through the first antenna 5, an enabling signal 17 to the safety device 8, which receives the enabling signal 17 either via the second antenna 13 or the transponder 10. Upon receipt of the enabling signal 17, the regulating element 9 interacts with at least one weapons mechanism (not shown) to enable the weapon 6 to shoot.

The regulating element 9 can be designed as an electromagnetic regulation element, which engages a trigger mechanism (not shown). In this example, a trigger rod (not shown) may be blocked, released or hooked off a trigger guard (not shown) or a hammer (not shown).

In another example utilization of the example system, in addition to the weapon identification 7, a user identification 11 is requested. This user identification 11 may also be stored in a transponder 12 (i.e., the user identification carrier 12), which the user of the weapon 6 carries with him. In this case, the global control signal 15 triggers the transmission of the user identification signal 18, which contains the user identification 11, to the enabling apparatus 1, which is then transmitted by the enabling apparatus 1 through the first antenna 5 to the control unit 2. The control unit 2 executes a comparison operation to determine if the transmitted user identification 11 matches a user identification that is already stored in the user identification memory 4. If there is a combined inquiry of weapon and user identification codes 7 and 11, the weapon-enabling signal 17 is only transmitted if both identification codes 7 and 11 are present in the memories 3, 4 accordingly. Therefore, certain weapon identification codes may be assigned to certain users. Consequently, not every user may use every weapon. To maintain the identification data, the enabling apparatus 1 may be equipped with an entry device 19 and/or a reading device 20. In some examples, the data and/or signal exchange, i.e., the communications occurs between the enabling apparatus 1 and the weapon 6 (i.e., the identification carriers or transponders 10 and 12) via radio waves. In other examples, the communication may occur optically, acoustically, through physical lines or in another suitable manner.

Figure 2:
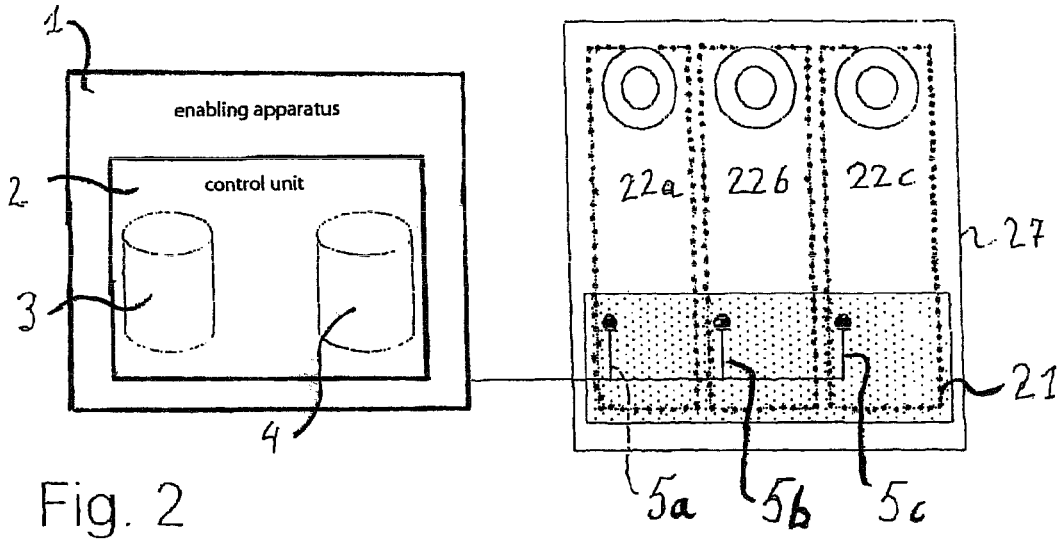
FIG. 2 shows a schematic illustration of a portion of the system of FIG. 1 operatively coupled to a plurality of antennas arranged at an example shooting range.
Figure 3:
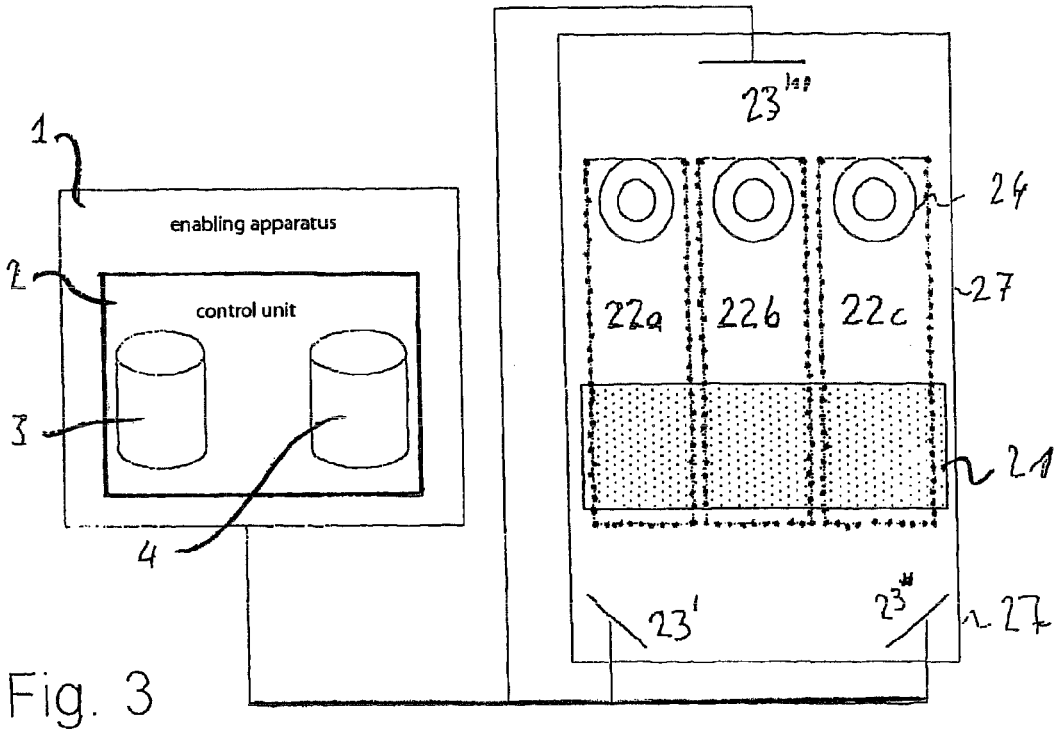
FIG. 3 shows a schematic illustration of a portion of the system of FIG. 1 operatively coupled to a plurality of directional antennas arranged at an example shooting range.
Figure 4:
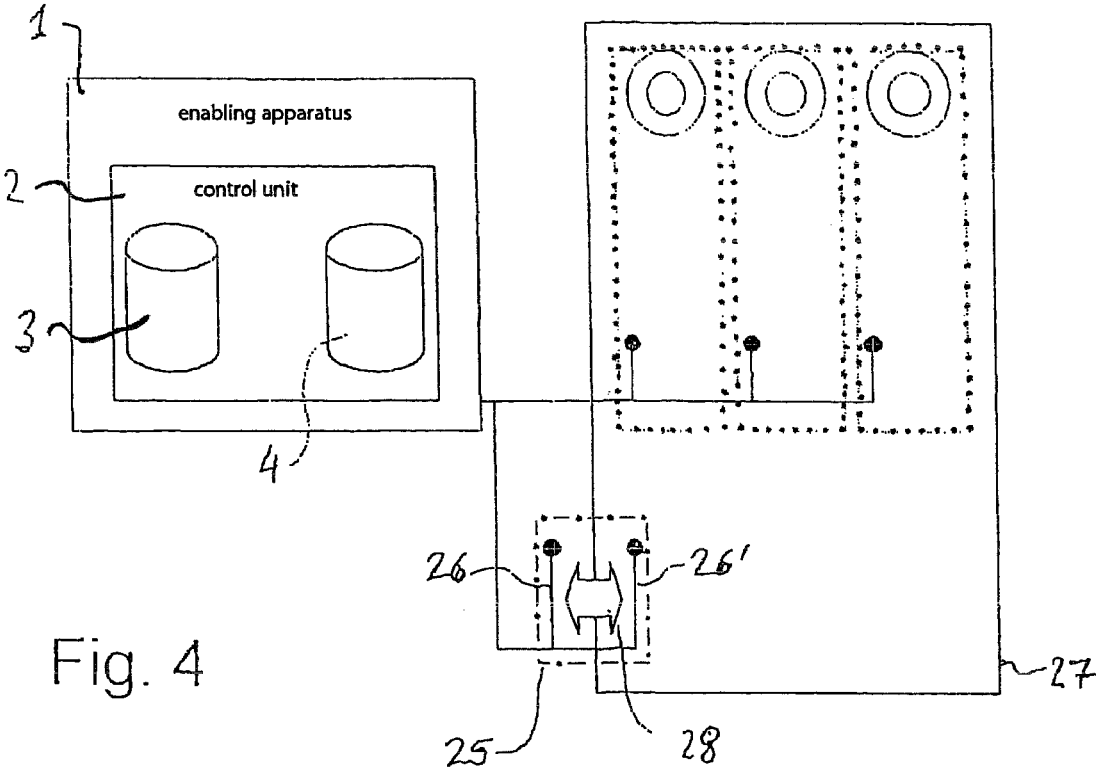
FIG. 4 shows a schematic illustration of an example shooting range that is equipped with an example access/removal control.

FIGS. 2-4 illustrate the example weapon safety system of FIG. 1 as implemented in a shooting range or facility 27. In the example shown in FIG. 2, the control unit 2 of the enabling apparatus 1 is connected to a plurality of first antennas 5*a*, 5*b* and 5*c*. The first antennas 5*a*, 5*b* and 5*c* are arranged in a shooting range or area 21 (area in which a user would hold weapon when aiming at a target) of the shooting facility 27, one in each of a plurality of a plurality of shooting lanes 22*a*, 22*b* and 22*c*. Thus, each first antenna 5*a*, 5*b*, and 5*c* is assigned to a particular shooting lane 22*a*, 22*b*, and 22*c*. If a registered user of a registered weapon 6 enters, for example, the shooting lane 22*a*, the exchange of identification 7, 11, and the enabling of the weapon 6 as described above occur through the first antenna 5*a*. In addition, the identifications 7, 11 may be recorded in the identification memories 3, 4 that the pertinent user or rifleman is only authorized for one of the shooting lanes 22*a*, 22*b* and 22*c*. Thus, the pertinent weapon 6 only may be shot by the pertinent user in one of the authorized shooting lanes 22*a*, 22*b* and 22*c*. In addition, it is also possible to cancel the enabling of the weapon 6 as soon as more than one user is present in one of the shooting lanes 22*a*, 22*b* and 22*c*. In addition, it can also be ensured that the weapon 6 is only enabled as long as the weapon 6 is located in the shooting range 21 of one of the shooting lanes 22*a*, 22*b*, 22*c*. Furthermore, in the arrangement shown in FIG. 2, the signal processing occurs nearly simultaneously for all captured identification codes 7, 11. Thus, even with sequential signal processing, to the extent there are delays, the actual delays are so small that a user cannot perceive them.

FIG. 3 shows an alternative example design in which the system is operable when the identification carriers or transponders 10, 12 and, thus, the weapon 6, are located anywhere throughout the entire shooting facility 27. In this example, the enabling apparatus 1 and the control unit 2 are equipped with directional antennas 23*a*, 23*b* and 23*c*. These directional antennas 23*a*, 23*b* and 23*c* allow the location of each identification carrier 10, 12 to be determined (for example, by triangulation) in their common action range. The control unit 2 may be arranged so that the enabling of a weapon is possible only in a certain range such as, for example, in the shooting range 21 of the shooting lanes 22*a*, 22*b* and 22*c*. Alternatively, the control unit 2 may be arranged to cover the entire shooting facility 27. Covering the entire shooting facility 27 makes possible other conditions for the enabling of a weapon. For example, the enabling may be blocked if a user wanders between the shooting range 21 and the target area 24 in one of the shooting lanes 22*a*, 22*b* and 22*c*. In this example, also, the signal for several identification carriers is processed nearly simultaneously.

FIG. 4 shows an example access control to the shooting facility 27, which provides enhanced safety. In an access area 25 (e.g., a doorway area) there are read/write devices or antennas 26 and 26' (which we refer to as "access antennas" for clarification), through which an exchange of signals with the enabling apparatus 1 occurs whenever anybody enters or leaves the shooting facility 27. However, in this arrangement, the enabling apparatus 1 acts here not on the safety device 8 in the weapon 6 but rather on an intermediate block 28 (e.g., a gate), which allows users to exit or enter the shooting facility 27. Consequently, access to the shooting facility 27 may be restricted to certain users and/or weapons 6 with the pertinent identification carriers 10, 12. It may also be ensured that only certain or even no weapons 6 that are equipped with relevant identification codes 7, 11 may be removed from the shooting facility 27. It is also possible to limit the removal of weapons 6 only to certain users. The recording of the identification codes 7, 11 of removed or returned weapons 6 facilitates bookkeeping of records. Thus, it is possible, for example, to determine at any time which users or which weapons 6 are present at the shooting facility 27, or which weapons 6 of which users have been removed from the shooting facility 27.

One of ordinary skill in the art will appreciate that the examples described herein are beneficial to the identification and enablement of weapons in manner that resolves the deficiencies of prior systems, namely that the example systems described herein facilitate the enabling of weapons individually, flexibly, centrally, and comprehensively. As described above, within the example systems, the weapon identification 7 is contained in the weapon identification carrier or transponder 10 that is associated with the weapon 6 and that, upon receiving the control signal 15 from the enabling apparatus 2, transmits the weapon identification signal 16 that includes the particular weapon identification 7, which is received by the enabling apparatus 1. The enabling signal 17 is only transmitted if it is verified in an authorization step that the weapon identification 7 (of a weapon that is ascertained within the action range of the enabling apparatus 1) matches a weapon identification registered in the weapons identification memory 3. Only when this authorization process occurs successfully is the encoded and weapon-individual enabling signal 17 transmitted to the weapon 67. When the authorization process does not occur successfully, i.e., the comparison of the received weapon identification 7 and the registered weapon identification do not match, the weapon 6 is not enabled. This system allows, by changing the identification memory 3, to centrally and simply determine which weapons are to be enabled. The example system may also be used to intentionally leave weapons that are generally suitable to be enabled non-enabled if their enabling is not desired or authorized. Thus, to ensure a weapon 6 is non-enabled and remains non-enabled, it is sufficient to only remove the weapon identification 7 of that weapon 6 from the weapon identification memory 3. This is particularly beneficial to control weapons that have been lost, stolen or misplaced.

As mentioned above, the example systems described herein may be used in the shooting facility 27, e.g., a shooting range, and may include the additional intermediate block or locking device (FIG. 4), in which the exchange of identification 7 or 11 with the enabling apparatus 1 may be performed by means of a write/reading device (illustrated via the access antennas 26 and 26'). The control unit 2 is set up in such a manner that the intermediate locking device only allows access to or exit from the shooting facility 27 if the identification 7 or 11 captured by the intermediate locking device matches an identification duly registered in the memory 3 or 4. This system allows, in addition to the actual enabling of the weapon 6, an effective access control for particular persons and/or particular weapons 6. Thus, the access to the shooting facility 27 may be restricted to properly registered persons and weapons 6. The exit (via access area 25, for example) from the shooting facility 27 also may be bound to a corresponding exchange of identification 7 and/or 11. This ensures greater safety because it controls the people and/or the weapons that enter or leave the shooting facility 27. For example, a person only may leave the shooting facility 27 without any weapon, i.e., certain or all weapons 6 must remain in the facility. The combination of person- and weapon-specific data may be used to restrict the removal of a weapon from the facility 27 to a certain group of persons and/or certain weapons.

As stated above, there example system may also include an exchange of user-specific identification 11. This combination of weapon- and user-specific identifications allows additional measures to increase the safety, an example of which is provided above. In addition, for example, the enabling of a weapon 6 may be restricted to a certain combination of user and weapon identification codes 7, 11. Thus, only a certain user or group of users is registered for one or more weapon identification codes 7 and vice versa.

Also, in some example, the identification codes 7, 11 may be changed through the enabling apparatus 1. Thus, encoding procedures may be performed, in which the identification 7, 11 is changed upon each exchange of identification 7, 11 according to a certain algorithm so that forging the identification is impossible or at least much more difficult, should unauthorized third parties get hold of the identification exchange signals 16, 18.

The example weapon safety system may additionally be equipped with a reading device, which allows storing weapon and/or user identification 7, 11 in an identification memory 3, 4. This allows the identification data to be safely accurately recorded in the identification memory 3, 4 without error. Alternatively, such data also may be entered through a corresponding entry device or a terminal 19, 20.

The recording of the weapon identification 7 in or on an identification carrier 10 allows for the independent manufacture of the weapon 6 and the creation of the identification 7 and/or the identification carrier 10. So, for example, even weapons 6 that have been manufactured without any suitable identification 7 can be subsequently equipped with the identification carrier 10 and with the safety device 8, with which they then become suitable for use in the weapon safety system described herein.

The example identification carriers 10 may be designed as an active or passive transponder. When designed as a passive transponder, the identification carrier 10 is activated by the signal energy transmitted by the enabling apparatus 1, which then allows the weapon identification 7 to be scanned by the enabling apparatus 1. The enabling apparatus 1 then sends the enabling signal 17 to the transponder 10, which then activates the safety device 8 to enable the weapon 6. The energy required to actuate the safety device 8 may be supplied by the signal energy sent by the enabling apparatus 1 and received by the antenna in the transponder 10. However, the safety device 8 also may be equipped with its own power supply, for example, in the form of a battery or a small accumulator, which supplies the safety device 8 with the energy required for controlling operations.

When designed as an active transponder, the identification carrier 10, the transponder 10 is activated over a switching signal and then transmits its own signal. Such transponders require a source of energy or external supply of energy. The safety device 8 and the transponder 10 mounted on the weapon 6 may jointly use a common power supply.

In some examples, the safety device 8 may act upon the trigger mechanism (not shown) and/or the trigger rod (not shown) through the regulating element 9, which may be, for example, an electromagnetic regulating element. It also may be possible that the trigger rod be locked in place so that the trigger mechanism cannot be actuated. Alternatively, it may be possible to hook off the trigger rod on the actual trigger guard (not shown) or the knock-over lever (not shown) by means of the regulating element 9 so that the hammer (not shown) and trigger guard are uncoupled from each other.

As described above, the exchange of information (e.g., the identification 7, 11) may occur via the first antenna 5. In some example systems, there may be a plurality of first antennas 5*a*, 5*b* and 5*c* (or more). The first antenna 5 is coupled to the enabling apparatus 1 and is communicatively coupled simultaneously with several weapons 6 and/or users. However, though there is seemingly simultaneous communication with a plurality of identification carriers 7, 11, the exchange of identification 7, 11 information actually occurs in sequence. However, the processing of these cycles, i.e., subsequent signals proceeds so quickly that a user cannot perceive them. Thus, the enabling of several weapons is perceived as occurring at the time.

As shown in FIG. 2 and discussed above, the system may be designed so there is an association or assignment of a weapon 6 to an antenna 5*a*, which ensures that within a certain action range of the antenna 5*a* only one single weapon 6 may be enabled to shoot. Therefore, for example, in a shooting lane 22*a* only one weapon 6 may be enabled at any given time, so that one antenna 5*a* is required per shooting lane. In other examples, the identification carriers 10, 12 may be localized through several antennas such as, for example the directional antennas 23, 23' and 23" of FIG. 3. Thus, the location of a weapon 6 or a user may be determined within the action range of the directional antenna 23, 23' and 23", and the enabling of the weapon 6 may be made dependent on whether the weapon 6 and/or the user are located in an particular area, for which the enabling of the weapon 6 is intended. Therefore, certain areas in the action range of the directional antennas 23, 23', and 23", in which it is possible to enable a weapon may be defined. In addition, each weapon 6 may be assigned a certain area (for example, a shooting lane 22*a*), in which the weapon 6 may be enabled. It is also possible to design a system where a weapon 6 may only be enabled if a certain user and a certain weapon are located in a certain area.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A weapon safety system in which the enabling of a weapon to shoot is controlled by an exchange of identification between the weapon and an enabling apparatus, the system comprising:

the weapon comprising:

a weapon identification code; and a safety device; and the enabling apparatus, wherein the enabling apparatus is designed to capture the weapon identification code and to transmit an enabling signal to the safety device in the weapon, wherein a control unit controls the enabling apparatus and includes an identification memory that includes at least one registered weapon identification;

wherein, upon receiving a control signal from the enabling apparatus, the weapon transmits an identification signal containing the weapon identification code;

wherein the enabling apparatus sends the enabling signal if the weapon identification code matches at least one of the registered weapon identification; and wherein the enabling apparatus may change the identification code.

2. A weapon safety system as defined in claim 1, wherein the enabling apparatus further includes an entry device for the registration of the weapon identification.

3. A weapon safety system as defined in claim 2, further comprising a weapon identification carrier, wherein the weapon identification code is located on or in the weapon identification carrier, and wherein the weapon identification carrier is either an active transponder or a passive transponder.

4. A weapon safety system as defined in claim 3, wherein the weapon identification carrier is coupled to the safety device, and wherein energy of the signal transmitted by the enabling apparatus activates the weapon identification carrier, and wherein, upon activation, the weapon identification carrier either:

transmits the weapon identification code to the enabling apparatus; and/or uses the received enabling signal to activate the safety device to enable the weapon to shoot.

5. A weapon safety system as defined in claim 4, wherein the safety device and the weapon identification carrier are equipped with a shared power supply.

6. A weapon safety system as defined in claim 5, wherein the power supply is a battery or an accumulator.

7. A weapon safety system as defined in claim 1, wherein the weapon further includes a regulation element and a trigger mechanism, wherein the safety device acts on the trigger mechanism through the regulation element.

8. A weapon safety system as defined in claim 7, wherein the regulation element is an electromagnetic element.

9. A weapon safety system as defined in claim 7, wherein the trigger mechanism includes a trigger rod.

10. A weapon safety system as defined in claim 1, further comprising a plurality of weapons with weapon identification codes, and wherein the enabling apparatus further includes an antenna through which a simultaneous exchange of the weapon identification codes with one or more of the plurality of the weapons.

11. A weapon safety system as defined in claim 10, wherein the enabling apparatus further includes a plurality of antennas, and the exchange of the weapon identification codes with one or more of the weapons occurs through a particular one of the antennas.

12. A weapon safety system as defined in claim 1, wherein during the exchange of the weapon identification, the location of the weapon is determined and the weapon-enabling signal is sent depending on the location of the weapon.

13. A weapon safety system as defined in claim 1, wherein the control unit comprises a computer.

14. A weapon safety system as defined in claim 1, wherein the identification memory further includes at least one registered user identification, and the system further comprises: a user identification code that is associated with a weapon user, wherein the enabling apparatus only transmits a weapon-enabling signal if the user identification code matches at least one registered user identification.

15. A weapon safety system as defined in claim 14, wherein the enabling apparatus further includes an entry device for the registration of the user identification.

16. A weapon safety system as defined in claim 14, wherein the user identification code is located on or in a user identification carrier.

17. A weapon safety system as defined in claim 16, wherein the user identification carrier is either an active transponder or a passive transponder.

18. A weapon safety system as defined in claim 14, wherein the enabling apparatus further includes a plurality of antennas, and the exchange of the user identification code with one or more of the users occurs through a particular one of the antennas.

19. A weapon safety system as defined in claim 14, wherein during the exchange of the user identification, the location of the user is determined and the weapon-enabling signal is sent depending on the location of the user.

20. A shooting facility comprising:

a shooting area; and a weapon safety system in which the enabling of a weapon to shoot is controlled by means of an exchange of identification between the weapon and an enabling apparatus, the system comprising:

the weapon comprising:

a weapon identification code; and a safety device; and the enabling apparatus, wherein the enabling apparatus is designed to capture the weapon identification code and to transmit an enabling signal to the safety device in the weapon, wherein a control unit controls the enabling apparatus and includes an identification memory that includes at least one registered weapon identification;

wherein, upon receiving a control signal from the enabling apparatus, the weapon transmits an identification signal containing the weapon identification code;

wherein the enabling apparatus sends the enabling signal if the weapon identification code matches at least one of the registered weapon identification; and wherein the enabling apparatus may change the identification code.

21. A shooting facility as defined in claim 20, further comprising:

an intermediate block that has with a writing/reading device for capturing the weapon identification codes, which is coupled to the enabling apparatus in a controllable fashion, and the control unit is designed in such a manner that the intermediate block only releases a gate for entering or exiting the either shooting facility or the shooting area if the weapon identification code captured at the intermediary block matches at least one of the registered weapon identifications.

22. A shooting facility as defined in claim 20, wherein the identification memory further includes at least one registered user identification, the system further includes a user identification code that is associated with a weapon user, wherein the enabling apparatus only transmits a weapon-enabling signal if the user identification code matches at least one registered user identification, and the shooting facility further comprises: an intermediate block that has with a writing/reading device for capturing user identification codes, which is coupled to the enabling apparatus in a controllable fashion, and the control unit is designed in such a manner that the intermediate block only releases a gate for entering or exiting the either shooting facility or the shooting area if the user identification code captured at the intermediary block matches at least one of the registered user identifications.

* * * * *